US010971799B2

(12) United States Patent
Lee et al.

(10) Patent No.: US 10,971,799 B2
(45) Date of Patent: Apr. 6, 2021

(54) ANTENNA MODULE AND ELECTRONIC DEVICE INCLUDING THEREOF

(71) Applicant: Samsung Electronics Co., Ltd., Suwon-si (KR)

(72) Inventors: Yousung Lee, Suwon-si (KR); Hyosung Lee, Suwon-si (KR); Namjun Cho, Suwon-si (KR); Hyoseok Na, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/943,096

(22) Filed: Jul. 30, 2020

(65) Prior Publication Data

US 2021/0036404 A1 Feb. 4, 2021

(30) Foreign Application Priority Data

Aug. 1, 2019 (KR) ..... 10-2019-0093844

(51) Int. Cl.
*H01Q 21/00* (2006.01)
*H01Q 1/22* (2006.01)
(Continued)

(52) U.S. Cl.
CPC ..... *H01Q 1/2283* (2013.01); *H01Q 1/22* (2013.01); *H01Q 3/34* (2013.01); *H01Q 5/10* (2015.01);
(Continued)

(58) Field of Classification Search
CPC .... H01Q 1/2283; H01Q 21/0006; H01Q 3/34; H01Q 21/061; H01Q 1/22; H01Q 21/00
(Continued)

(56) References Cited

U.S. PATENT DOCUMENTS 7,009,560 B1 3/2006 Lam et al.
9,547,069 B2 1/2017 Forstner et al.
(Continued)

FOREIGN PATENT DOCUMENTS

WO 2018110083 A1 6/2018

OTHER PUBLICATIONS

International Search Report dated Nov. 19, 2020, issued in an International Application No. PCT/KR2020/010088.
(Continued)

*Primary Examiner* — Hai V Tran
(74) *Attorney, Agent, or Firm* — Jefferson IP Law, LLP

(57) ABSTRACT

An electronic device is provided. The electronic device includes an antenna module including an antenna array. The antenna module includes a printed circuit board, conductive lines formed on the printed circuit board, each of the conductive lines having different lengths, a communication circuit including a first switch connected to ends of the conductive lines, and a front-end including a second switch connected to opposite ends of the conductive lines and phase shifters connected to the second switch. Based on a direction of a beam to be formed by the antenna array, a processor connected to the antenna module is configured to control the first switch and the second switch to select at least one of the conductive lines and to control a phase value of at least one of the phase shifters connected to the selected conductive line, based on a length of the selected conductive line.

23 Claims, 6 Drawing Sheets

(51) Int. Cl.
*H01Q 3/34* (2006.01)
*H01Q 21/06* (2006.01)
*H01Q 5/10* (2015.01)

(52) U.S. Cl.
CPC ..... *H01Q 21/00* (2013.01); *H01Q 21/0006* (2013.01); *H01Q 21/061* (2013.01)

(58) Field of Classification Search
USPC ..... 343/702
See application file for complete search history.

(56) References Cited

U.S. PATENT DOCUMENTS 9,948,408 B1 * 4/2018 Gomadam ..... H04B 7/04
2004/0209572 A1 10/2004 Thomas
2006/0284783 A1 * 12/2006 Mohamadi ..... H01Q 21/065 343/853
2007/0069948 A1 * 3/2007 Liu ..... H01Q 3/24 342/374
2009/0027286 A1 * 1/2009 Ohishi ..... H01Q 9/42 343/750
2009/0270051 A1 10/2009 Choi et al.
2011/0273325 A1 11/2011 Goldman
2013/0088383 A1 4/2013 Forstner et al.
2014/0241463 A1 8/2014 Leenaerts et al.
2016/0359461 A1 12/2016 He et al.
2018/0241122 A1 * 8/2018 Jalali Mazlouman ... H01Q 3/36
2019/0013582 A1 * 1/2019 Li ..... H01Q 1/246
2019/0319663 A1 10/2019 Shimura
2019/0386397 A1 * 12/2019 Son ..... H04B 1/40

OTHER PUBLICATIONS

Extended European Search Report dated Dec. 9, 2020, issued in a counterpart European Application No. 20188885.6-1220.

* cited by examiner

ANTENNA MODULE AND ELECTRONIC DEVICE INCLUDING THEREOF

CROSS-REFERENCE TO RELATED APPLICATION(S)

This application is based on and claims priority under 35 U.S.C. § 119(a) of a Korean patent application number 10-2019-0093844, filed on Aug. 1, 2019, in the Korean Intellectual Property Office, the disclosure of which is incorporated by reference herein in its entirety.

BACKGROUND

1. Field

The disclosure relates to a technology of adjusting beams of an antenna module.

2. Description of Related Art

With the development of a mobile communication technology, an electronic device equipped with an antenna, such as a smartphone or a wearable device, is being widely supplied. The electronic device may receive or transmit a signal including data (e.g., a message, a photo, a video, a music file, or a game) through the antenna. The electronic device may deliver the received signal to a radio frequency integrated circuit (RFIC), using the antenna.

The antenna of the electronic device is implemented using a plurality of antenna elements to receive or transmit a signal more efficiently. For example, the electronic device may include one or more antenna arrays in each of which a plurality of antenna elements are arranged in a regular shape. An antenna array may have an effective isotropically radiated power (EIRP) greater than one antenna element. As such, the electronic device including an antenna array may receive or transmit a signal efficiently.

The above information is presented as background information only to assist with an understanding of the disclosure. No determination has been made, and no assertion is made, as to whether any of the above might be applicable as prior art with regard to the disclosure.

SUMMARY

In $5^{th}$ generation (5G) mobile communication, because the high data transmission rate is required, millimeter wave (mmWave) frequency band communication, which easily secures broadband width, has been adopted as a standard. However, due to a high path loss in mmWave frequency band, low diffraction features, or the limitation of semiconductor processing, the electronic device may include a phased array system. An amplifier included in RFIC may be formed of a complementary metal-oxide semiconductor (CMOS). However, because the CMOS amplifier has low output power, the degraded performance due to the low power efficiency, and heating, the structure where the RFIC implemented with CMOS and the radio frequency front-end (RFFE) implemented with a heterogeneous compound semiconductor are separated into two separate chips is considered. However, when circuits previously integrated in a single chip are separated into two chips, the mounting area may increase for reasons such as minimum spared distance between chips and interface routing.

Aspects of the disclosure are to address at least the above-mentioned problems and/or disadvantages and to provide at least the advantages described below. Accordingly, an aspect of the disclosure is to provide an antenna module including an RFIC chip and a separate RFFE chip (e.g., including an amplifier and a phase shifter), and an electronic device including the same. The antenna module may include a phase shift interface interposed between the RFIC chip and the RFFE chip.

Additional aspects will be set forth in part in the description which follows and, in part, will be apparent from the description, or may be learned by practice of the presented embodiments.

In accordance with an aspect of the disclosure, an electronic device is provided. The electronic device includes an antenna module including an antenna array including a plurality of antenna elements and a processor operatively connected to the antenna module. The antenna module may include a printed circuit board, conductive lines formed on the printed circuit board, each of the conductive lines having different lengths, a communication circuit including a first switch connected to ends of the conductive lines, and a front-end including a second switch connected to opposite ends of the conductive lines and phase shifters connected to the second switch. The phase shifters may be connected to the plurality of antenna elements. Based on a direction of a beam to be formed by the antenna array, the processor may be configured to control the first switch and the second switch to select at least one of the conductive lines and to control a phase value of at least one of the phase shifters connected to the selected conductive line, based on a length of the selected conductive line.

In accordance with another aspect of the disclosure, an electronic device is provided. The electronic device includes an antenna module including an antenna array including a plurality of antenna elements and a processor operatively connected to the antenna module. The antenna module may include a printed circuit board, a communication circuit mounted on the printed circuit board and including first access nodes, a front-end mounted on the printed circuit board and including second access nodes and phase shifters connected to one selected among the second access nodes, and a phase shift interface interposed between the communication circuit and the front-end and including conductive lines connecting the first access nodes to the second access nodes, each of the conductive lines having different lengths. The phase shifters may be connected to the plurality of antenna elements. Based on a direction of a beam to be formed by the antenna array, the processor may be configured to select at least one of the conductive lines and to control a phase value of at least one of the phase shifters connected to the selected conductive line, based on a length of the selected conductive line.

In accordance with another aspect of the disclosure, an electronic device is provided. The electronic device includes an antenna module including an antenna array including a plurality of antenna elements and a processor operatively connected to the antenna module. The antenna module may include a printed circuit board, a communication circuit mounted on the printed circuit board and including first access nodes, a front-end mounted on the printed circuit board and including second access nodes and a vector modulator connected to the second access nodes and a phase shift interface interposed between the communication circuit and the front-end and including conductive lines for implementing at least one phase difference by connecting the first access nodes to the second access nodes. The vector modulator may provide the plurality of antenna elements with radio frequency (RF) signals, on which a phase shift is performed based on differential in-phase and quadrature (I-Q) signals generated depending on the at least one phase difference. The processor may be configured to control the vector modulator based on a direction of a beam formed by the antenna array.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
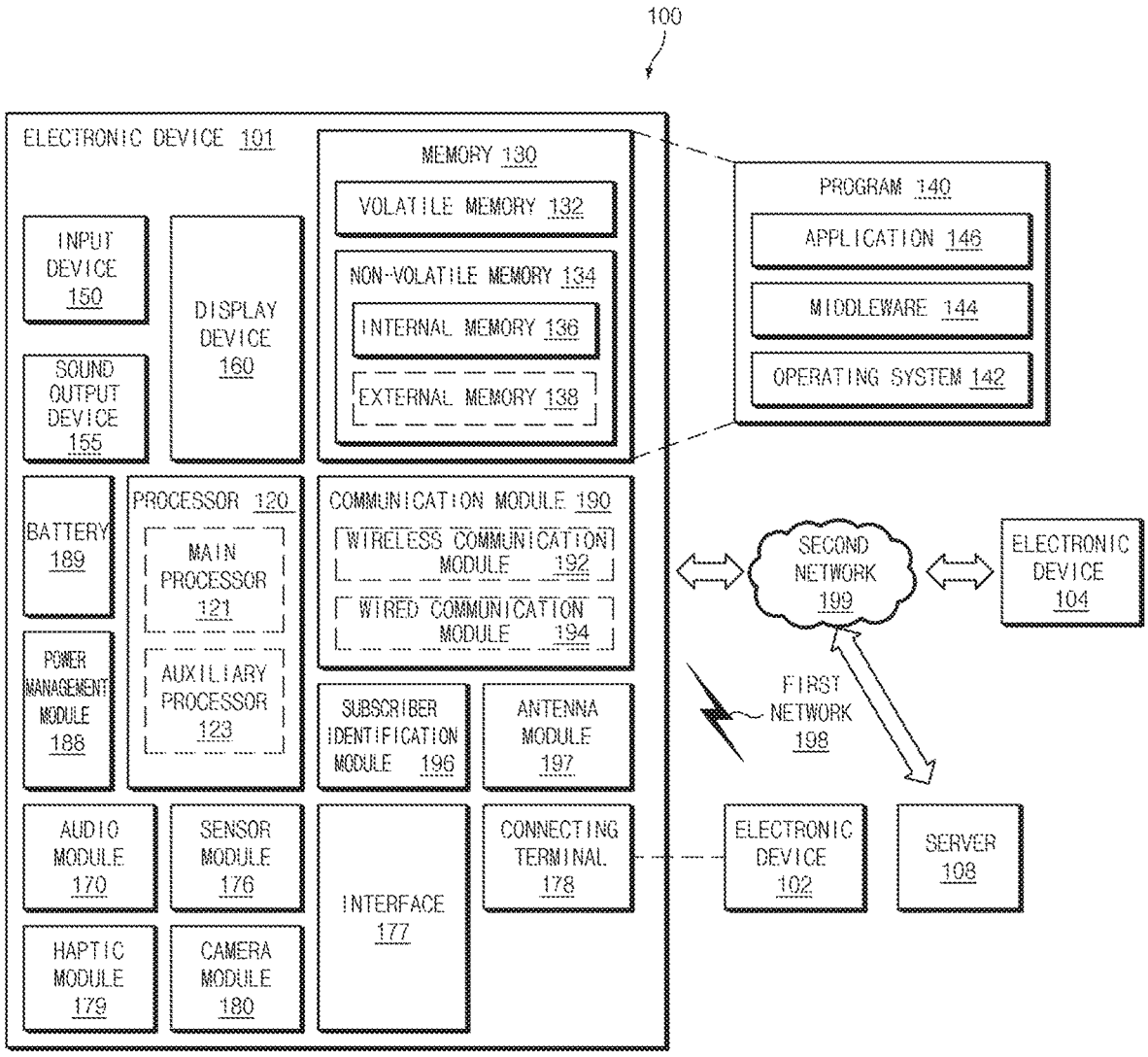
FIG. 1 is a block diagram illustrating an electronic device in a network environment according to an embodiment of the disclosure.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) there between via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
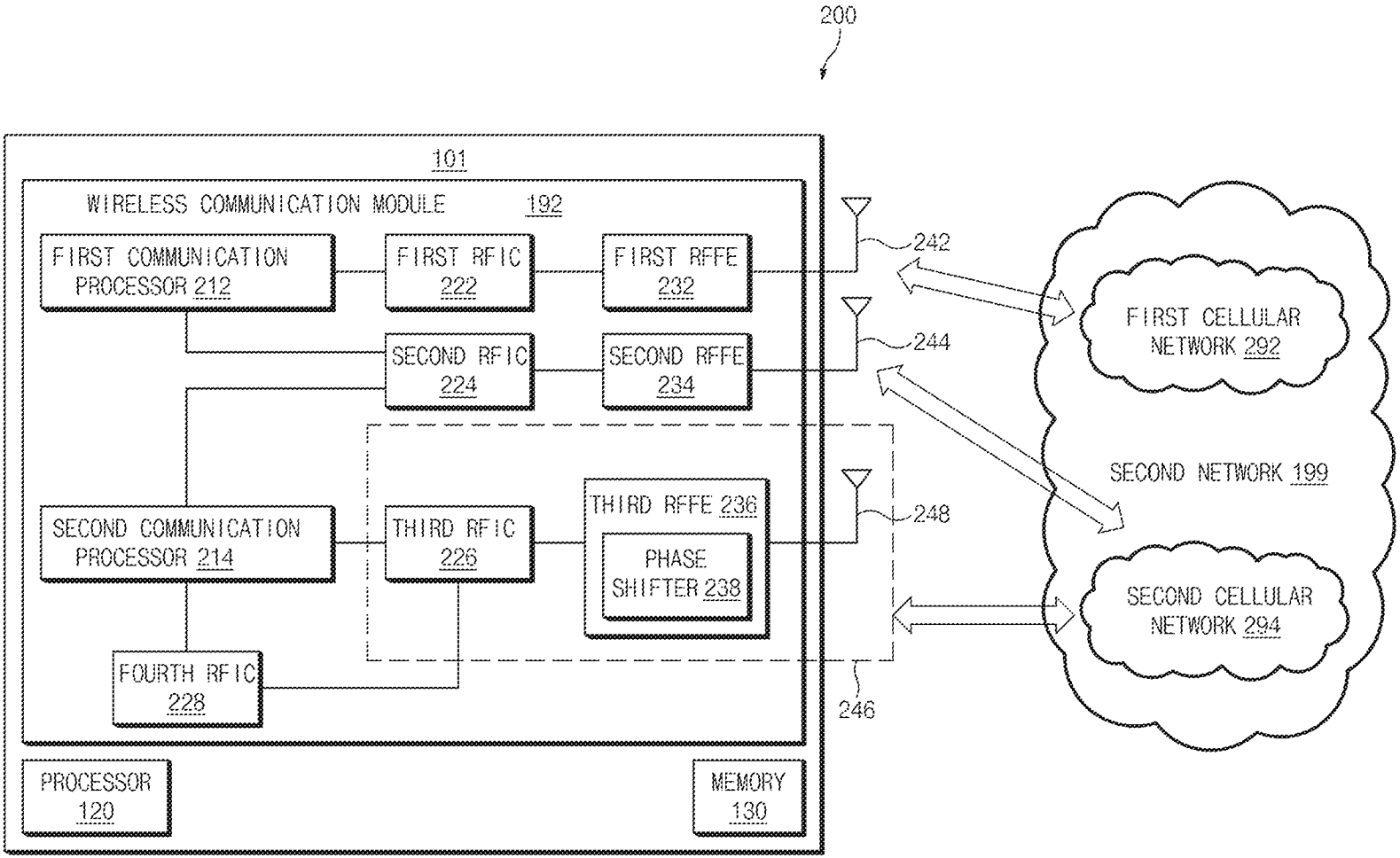
FIG. 2 is a block diagram of an electronic device for supporting legacy network communication and 5G network communication, according to an embodiment of the disclosure.

FIG. 2 is a block diagram of an electronic device for supporting legacy network communication and 5G network communication, according to an embodiment of the disclosure.

Referring to FIG. 2, the electronic device 101 may include a first communication processor 212, a second communication processor 214, a first radio frequency integrated circuit (RFIC) 222, a second RFIC 224, a third RFIC 226, a fourth RFIC 228, a first radio frequency front-end (RFFE) 232, a second RFFE 234, a third RFFE 236, a first antenna module 242, a second antenna module 244, and a third antenna module 246. The electronic device 101 may further include the processor 120 and the memory 130. The second network 199 may include a first cellular network 292 and a second cellular network 294. According to another embodiment, the electronic device 101 may further include at least one component of the components illustrated in FIG. 1, and the second network 199 may further include at least another network. According to an embodiment, the first communication processor 212, the second communication processor 214, the first RFIC 222, the second RFIC 224, the fourth RFIC 228, the first RFFE 232, and the second RFFE 234 may form at least part of the wireless communication module 192. According to another embodiment, the fourth RFIC 228 may be omitted or may be included as a part of the third RFIC 226.

The first communication processor 212 may support the establishment of a communication channel of a band to be used for wireless communication with the first cellular network 292 and the legacy network communication through the established communication channel According to various embodiments, the first cellular network 292 may be a legacy network including second generation (2G), third generation (3G), fourth generation (4G), and/or long term evolution (LTE) network. The second communication processor 214 may support the establishment of a communication channel corresponding to a specified band (e.g., about 6 GHz~about 60 GHz) among bands to be used for wireless communication with the second cellular network 294 and 5G network communication via the established communication channel. According to various embodiments, the second cellular network 294 may be a 5G network defined in the third generation partnership project (3GPP). Additionally, according to an embodiment, the first communication processor 212 or the second communication processor 214 may establish a communication channel for a specified band (e.g., about 6 GHz or lower) of the bands to be used for wireless communication with the second cellular network 294 and may support 5G network communication through the established communication channel According to an embodiment, the first communication processor 212 and the second communication processor 214 may be implemented within a single chip or a single package. According to various embodiments, the first communication processor 212 or the second communication processor 214 may be implemented within a single chip or a single package with the processor 120, the auxiliary processor 123 of FIG. 1, or the communication module 190.

At the time of transmission, the first RFIC 222 may convert a baseband signal generated by the first communication processor 212 to a radio frequency (RF) signal of about 700 MHz to about 3 GHz used for the first cellular network 292 (e.g., a legacy network). At the time of reception, the RF signal may be obtained from the first cellular network 292 (e.g., a legacy network) via an antenna (e.g., the first antenna module 242) and may be preprocessed via the first RFFE 232. The first RFIC 222 may convert the preprocessed RF signal into a baseband signal so as to be processed by the first communication processor 212.

At the time of transmission, the second RFIC 224 may convert a baseband signal generated by the first communication processor 212 or the second communication processor 214 into an RF signal (hereinafter referred to as a "5G Sub6 RF signal") in a Sub6 band (e.g., about 6 GHz or lower) used in the second cellular network 294 (e.g., a 5G network). At the time of reception, the 5G Sub6 RF signal may be obtained from the second cellular network 294 (e.g., 5G network) via an antenna (e.g., the second antenna module 244) and may be preprocessed via the second RFFE 234. The second RFIC 224 may convert the preprocessed 5G Sub6 RF signal into a baseband signal so as to be processed by a communication processor corresponding to the 5G Sub6 RF signal from among the first communication processor 212 or the second communication processor 214.

The third RFIC 226 may convert a baseband signal generated by the second communication processor 214, to an RF signal (hereinafter referred to as a "5G Above6 RF signal") of a 5G Above6 band (e.g., about 6 GHz~about 60 GHz) to be used for the second cellular network 294 (e.g., 5G network). At the time of reception, the 5G Above6 RF signal may be obtained from the second cellular network 294 (e.g., 5G network) via an antenna (e.g., the antenna 248) and may be preprocessed via the third RFFE 236. For example, the third RFFE 236 may preprocess a signal, using a phase shifter 238. The third RFIC 226 may convert the preprocessed 5G Above6 RF signal into a baseband signal to be processed by the second communication processor 214. According to an embodiment, the third RFFE 236 may be formed as the part of the third RFIC 226; alternatively, each of the third RFFE 236 and the third RFIC 226 may be formed as a separate chip.

According to an embodiment, the electronic device 101 may include the fourth RFIC 228 independently of the third RFIC 226 or as at least part of the third RFIC 226. In this case, the fourth RFIC 228 may convert the baseband signal generated by the second communication processor 214, to an RF signal (hereinafter referred to as an intermediate frequency (IF) signal) of an intermediate frequency band (e.g., about 9 GHz~about 11 GHz) and then may deliver the IF signal to the third RFIC 226. The third RFIC 226 may convert the IF signal to the 5G Above6 RF signal. At the time of reception, the 5G Above6 RF signal may be received from the second cellular network 294 (e.g., 5G network) via an antenna (e.g., the antenna 248) and may be converted to the IF signal by the third RFIC 226. The fourth RFIC 228 may convert the IF signal into a baseband signal to be processed by the second communication processor 214.

According to an embodiment, the first RFIC 222 and the second RFIC 224 may be implemented with at least part of a single chip or a single package. According to an embodiment, the first RFFE 232 and the second RFFE 234 may be implemented as at least part of a single chip or a single package. According to an embodiment, at least one of the first antenna module 242 or the second antenna module 244 may be omitted or may be combined with any other antenna module to process RF signals in a plurality of bands.

According to an embodiment, the third RFIC 226, the third RFFE 236, and the antenna 248 may be disposed on the same substrate (e.g., a printed circuit board (PCB)) to form the third antenna module 246. For example, the wireless communication module 192 or the processor 120 may be disposed on a first substrate (e.g., a main PCB). In this case, the third RFIC 226 and the third RFFE 236 may be disposed in a partial region (e.g., on a lower surface) of a second substrate (e.g., a sub PCB) independent of the first substrate, and the antenna 248 may be disposed in another partial region (e.g., on an upper surface) of the second substrate. As such, the third antenna module 246 may be formed. According to an embodiment, the antenna 248 may include, for example, an antenna array to be used for beamforming. It is possible to reduce the length of the transmission line between the third RFIC 226, the third RFFE 236, and the antenna 248 by placing third RFIC 226, the third RFFE 236, and the antenna 248 on the same substrate. The decrease in the transmission line may make it possible to reduce the loss (or attenuation) of a signal in a high-frequency band (e.g., approximately 6 GHz to approximately 60 GHz) used for the 5G network communication due to the transmission line. For this reason, the electronic device 101 may improve the quality or speed of communication with the second cellular network 294 (e.g., 5G network).

The second cellular network 294 (e.g., a 5G network) may be used independently of the first cellular network 292 (e.g., a legacy network) (e.g., stand-alone (SA)) or may be used in conjunction with the first cellular network 292 (e.g., non-stand alone (NSA)). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may then access an external network (e.g., Internet) under control of the core network (e.g., an evolved packed core (EPC)) of the legacy network. Protocol information (e.g., LTE protocol information) for communication with the legacy network or protocol information (e.g., New Radio (NR) protocol information) for communication with the 5G network may be stored in the memory 130 and may be accessed by another component (e.g., the processor 120, the first communication processor 212, or the second communication processor 214).

Figure 3:
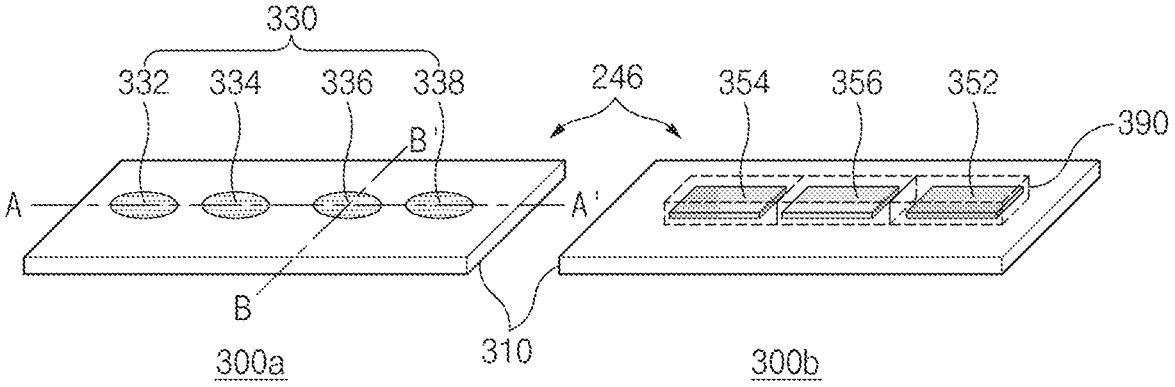
FIG. 3 illustrates an embodiment of a structure of a third antenna module described with reference to FIG. 2 according to an embodiment of the disclosure.
Figure 3:
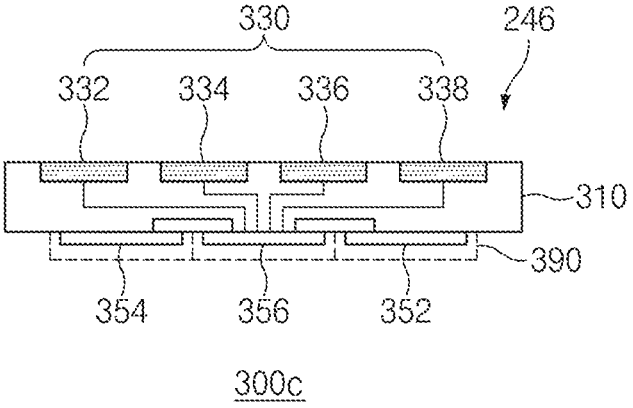

FIG. 3 illustrates an embodiment of a third antenna module described with reference to FIG. 2 according to an embodiment of the disclosure.

Referring to FIG. 3, perspective 300*a* is a perspective view of the third antenna module 246 when viewed from one side, and perspective 300*b* is a perspective view of the third antenna module 246 when viewed from another side. perspective 300*c* is a cross-sectional view of the third antenna module 246 taken along a line A-A'.

Referring to FIG. 3, in an embodiment, the third antenna module 246 may include a printed circuit board 310, an antenna array 330, an RFIC 352, a power management integrated circuit (PMIC) 354, an RFFE 356, and a module interface (not illustrated). Selectively, the third antenna module 246 may further include a shielding member 390. In various embodiments, at least one of the above-described components may be omitted, or at least two of the components may be integrally formed.

The printed circuit board 310 may include a plurality of conductive layers and a plurality of non-conductive layers, and the conductive layers and the non-conductive layers may be alternately stacked. The printed circuit board 310 may provide the electrical connection between various electronic components disposed on the printed circuit board 310 or on the outside, using wires and conductive vias formed in the conductive layers.

The antenna array 330 (e.g., the antenna 248 of FIG. 2) may include a plurality of antenna elements 332, 334, 336, and 338 disposed to form a directional beam. As illustrated in drawings, the antenna elements may be formed on a first surface of the printed circuit board 310 as illustrated. According to various embodiments, the antenna array 330 may be formed within the printed circuit board 310. According to embodiments, the antenna array 330 may include a plurality of antenna arrays (e.g., a dipole antenna array and/or a patch antenna array), the shapes or kinds of which are identical or different.

The RFIC 352 (e.g., the third RFIC 226 of FIG. 2) may be disposed on another region (e.g., a second surface facing away from the first surface) of the printed circuit board 310 so as to be spaced from the antenna array 330. The RFIC 352 may be configured to process a signal in the selected frequency band, which is transmitted/received through the antenna array 330. According to an embodiment, at the time of transmission, the RFIC 352 may convert a baseband signal obtained from a communication processor (e.g., the second communication processor 214 of FIG. 2) into an RF signal. At the time of reception, the RFIC 352 may convert an RF signal received through the antenna array 330 and the RFFE 356 into a baseband signal and may deliver the baseband signal to the communication processor.

According to another embodiment, at the time of transmission, the RFIC 352 may up-convert an IF signal (e.g., approximately 9 GHz to approximately 11 GHz) obtained from an intermediate frequency integrated circuit (IFIC) (e.g., the fourth RFIC 228 of FIG. 2) into an RF signal. At the time of reception, the RFIC 352 may down-convert an RF signal obtained through the antenna array 330 and the RFFE 356 into an IF signal and may deliver the IF signal to the IFIC.

The PMIC 354 may be disposed on another region (e.g., the second surface) of the printed circuit board 310, which is spaced from the antenna array 330. For example, the PMIC 354 may be supplied with a voltage from a main PCB (not illustrated) and may provide a power necessary for various components (e.g., the RFIC 352 and the RFFE 356) on an antenna module.

The shielding member 390 may be disposed at the part (e.g., on the second surface) of the printed circuit board 310 such that at least one of the RFIC 352, the RFFE 356, or the PMIC 354 is electromagnetically shielded. According to an embodiment, the shielding member 390 may include a shield can.

Although not illustrated in drawings, in various embodiments, the third antenna module 246 may be electrically connected with another printed circuit board (e.g., a main PCB) through a module interface. The module interface may include a connection member, for example, a coaxial cable connector, a board to board connector, an interposer, or a flexible printed circuit board (FPCB). The RFIC 352, the RFFE 356, and/or the PMIC 354 of the third antenna module 246 may be electrically connected with the printed circuit board through the connection member.

Figure 4:
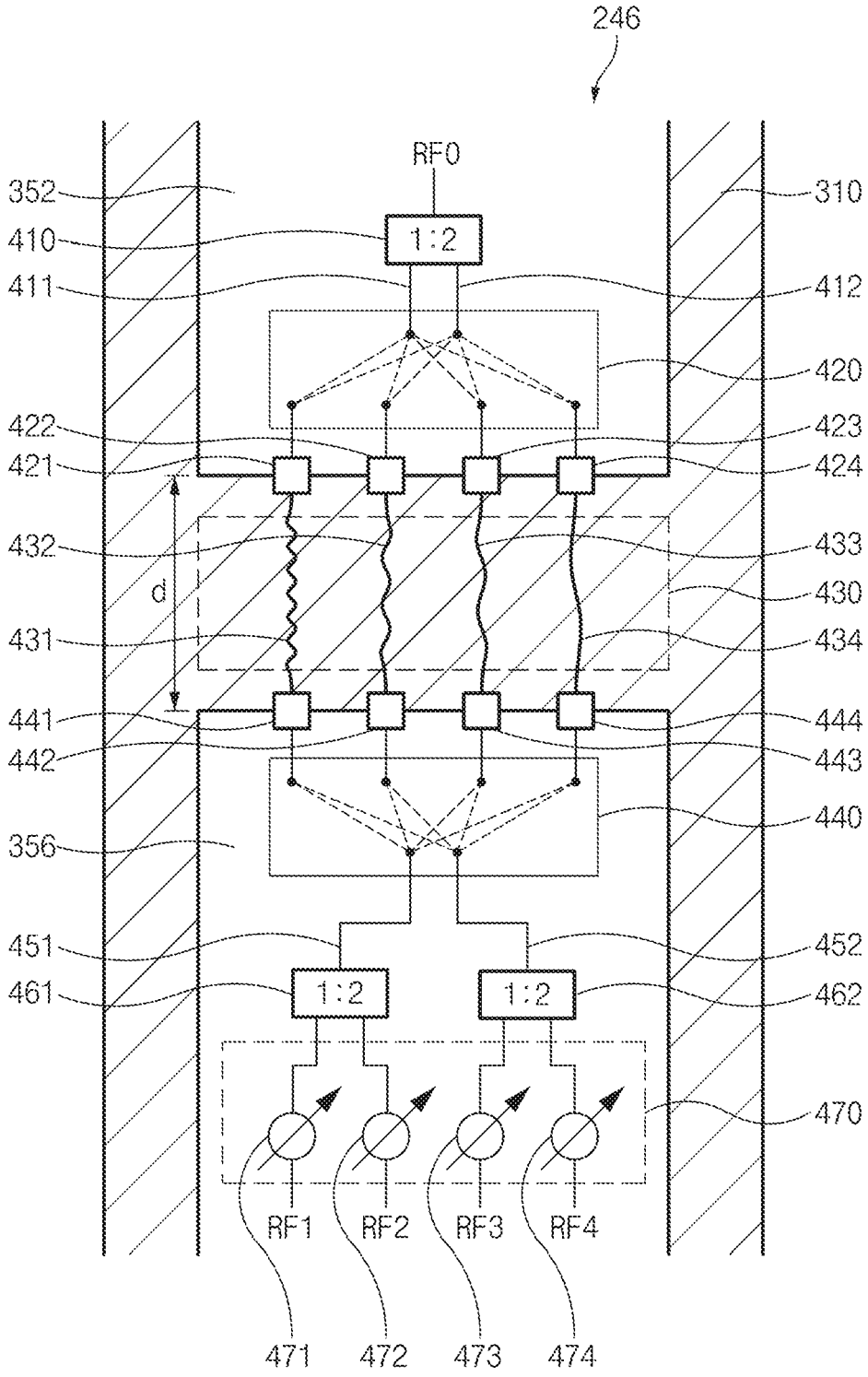
FIG. 4 is a diagram illustrating a connection structure of an RFFE chip including an RFIC chip and phase shifters according to an embodiment of the disclosure.

FIG. 4 is a diagram illustrating a connection structure of an RFFE chip including an RFIC chip and phase shifters according to an embodiment of the disclosure.

Referring to FIG. 4, according to an embodiment, the third antenna module 246 may include the printed circuit board 310, the RFIC 352, a phase shift interface 430, and/or the RFFE 356. Each of the RFIC 352 and the RFFE 356 may be formed of a single chip. In an embodiment, the RFIC 352 and/or the RFFE 356 may be mounted on the printed circuit board 310. The printed circuit board 310 may include antenna elements (e.g., the antenna element 332, 334, 336, or 338 of FIG. 3).

For example, when the RFIC 352 and RFFE 356 are formed as a single chip without the phase shift interface 430, in the case where the third antenna module 246 performs phase shift of total 4 bits, a phase shift circuit 470 needs to perform all phase shifts of 4 bits. For example, when antenna elements are arranged in 1×4 array and an antenna interval is $\lambda/2$ (e.g., $\lambda$ is the length of the wavelength of the signal transmitted and received through an antenna), the phase values of first to fourth phase shifters 471 to 474 may be set as shown in Table 1 to determine the direction (e.g., Beam Angle) of transmit (TX) beam and/or receive (RX) beam.

Referring to Table 1, each of the first to fourth phase shifters 471 to 474 may be set to one of phase values between 0 and 360 degrees. For example, the first to fourth phase shifters 471 to 474 may represent a phase value, using the total number of bits (e.g., 4 bits) used for phase shift in the third antenna module 246.

TABLE 1

| First phase shifter (471) | Second phase shifter (472) | Third phase shifter (473) | Fourth phase shifter (474) | Beam Angle |
|---|---|---|---|---|
| 337.5° | 225° | 112.5° | 0° | −38.7° |
| 270° | 180° | 90° | 0° | −30.00° |
| 202.5° | 135° | 67.5° | 0° | −22° |
| 135° | 90° | 45° | 0° | −14.48° |
| 67.5° | 45° | 22.5° | 0° | −7.2° |
| 0° | 0° | 0° | 0° | 0.00° |
| 0° | 22.5° | 45° | 67.5° | 7.2 ° |

TABLE 1-continued

| First phase shifter (471) | Second phase shifter (472) | Third phase shifter (473) | Fourth phase shifter (474) | Beam Angle |
|---|---|---|---|---|
| 0° | 45° | 90° | 135° | 14.48° |
| 0° | 67.5° | 135° | 202.5° | 22° |
| 0° | 90° | 180° | 270° | 30.00° |
| 0° | 112.5° | 225° | 337.5° | 38.7° |

For example, a single RFIC chip (e.g., the single chip including the functions of the RFIC 352 and the RFFE 356) may be implemented as a complementary metal-oxide semiconductor (CMOS). However, when the RFIC chip is implemented with the CMOS, an amplifier included in the RFIC chip may have low output power and low power efficiency. Accordingly, when the amplifier is separately positioned in a separate RFFE chip (e.g., the RFFE 356) and the RFFE chip is implemented with a heterogeneous compound semiconductor (e.g., GaAs or GaN), the output power and power efficiency of the amplifier may be increased. However, when the RFIC chip is separated into two chips (e.g., the RFIC 352+the RFFE 356), the mounting area may be increased due to the minimum spared distance between chips and interface routing. Furthermore, when the RFFE 356 is implemented with a heterogeneous compound semiconductor, a larger area may be required as compared with the case where the RFFE 356 is implemented with CMOS. Hereinafter, in FIGS. 4 to 6, the two chips (e.g., the RFIC 352+the RFFE 356) may be formed separately; embodiments of the antenna module structure where the mounting area is not increased as compared with the case of forming a single RFIC chip will be described.

According to an embodiment, the RFIC 352 may include a band conversion circuit (not illustrated) that converts a baseband signal (or IF signal) into an RF signal RF0 in a specified band or converts the RF signal RF0 into the baseband signal (or IF signal), a first divider 410, a first switch 420, and/or first to fourth RFIC nodes 421 to 424. For example, a first distribution line 411 or a second distribution line 412 may be connected between the first divider 410 and the first switch 420. The first switch 420 may connect one of the first and second distribution lines 411 and 412 to one of the first to fourth RFIC nodes 421 to 424. For example, the first switch 420 may include a double-pole 4-throw (DP4T) switch.

According to an embodiment, the RFFE 356 may include first to fourth RFFE nodes 441 to 444, a second switch 440, a second divider 461, a third divider 462, and/or the phase shift circuit 470 (e.g., the phase shifter 238 of FIG. 2). For example, the phase shift circuit 470 may include the first to fourth phase shifters 471 to 474. The first to fourth phase shifters 471 to 474 may be connected to the antenna elements. An amplifier (not illustrated) may be interposed between the first to fourth phase shifters 471 to 474 and the antenna elements. At the time of transmission, the amplifier may include a power amplifier (PA) that amplifies first to fourth RF signals RF1 to RF4 output by the first to fourth phase shifters 471 to 474 and then supplies the amplified signals to the antenna elements. Alternatively, at the time of reception, the amplifier may include a low noise amplifier (LNA) that amplifies weak signals received from the antenna elements and delivers the first to fourth RF signals RF1 to RF4 to the first to fourth phase shifters 471 to 474.

According to an embodiment, the third distribution line 451 may be connected between the second switch 440 and the second divider 461. The fourth distribution line 452 may be connected between the second switch 440 and the third divider 462. The second switch 440 may connect one of the third and fourth distribution lines 451 and 452 to one of the first to fourth RFFE nodes 441 to 444. For example, the second switch 440 may be a double-pole 4-throw (DP4T) switch. The second divider 461 may be connected to the first phase shifter 471 and/or the second phase shifter 472. The third divider 462 may be connected to the third phase shifter 473 and/or the fourth phase shifter 474.

According to an embodiment, the phase shift interface 430 may connect the first to fourth RFIC nodes 421 to 424 to the first to fourth RFFE nodes 441 to 444. For example, the phase shift interface 430 may include first to fourth phase shift lines 431 to 434. The first phase shift line 431 may connect the first RFIC node 421 to the first RFFE node 441. The second phase shift line 432 may connect the second RFIC node 422 to the second RFFE node 442. The third phase shift line 433 may connect the third RFIC node 423 to the third RFFE node 443. The fourth phase shift line 434 may connect the fourth RFIC node 424 to the fourth RFFE node 444.

According to an embodiment, the first to fourth phase shift lines 431 to 434 may have different lengths from one another. For example, the second to fourth phase shift lines 432 to 434 may be formed to have a specified phase difference (e.g., 60 degrees, 120 degrees, or 180 degrees) from that of the first phase shift line 431. For example, when the length of the wavelength of the RF signal RF0 is λ and the distance between the RFIC nodes 421 to 424 and the RFFE nodes 441 to 444 is 'd', the first phase shift line 431 may have a length of 'd+λ'. The second phase shift line 432 may have a length of 'd+λ/2'. The third phase shift line 433 may have a length of 'd+λ/4'. The fourth phase shift line 434 may have a length of 'd+λ/8'. In an embodiment, the phase shift interface 430 may be formed on one of the conductive layers of the printed circuit board 310.

According to an embodiment, the phase shift interface 430 and the phase shift circuit 470 may share a phase shift operation to perform the phase shift operation. For example, the phase shift interface 430 may perform phase shift of 1 bit. The phase shift circuit 470 may perform phase shift of the remaining bits. For example, when the third antenna module 246 performs phase shift of total 4 bits, the phase shift interface 430 may perform phase shift of 1 bit, and the phase shift circuit 470 may perform phase shift of 3 bits. Accordingly, the phase shift circuit 470 only needs to perform phase shift of 3 bits, which is less than 4 bits by 1 bit when the phase shift of 4 bits is performed by the third antenna module 246, and thus the phase shift circuit 470 may be implemented with a smaller area than the phase shifter of 4 bits. For example, the increase in the area by the phase shift interface 430, the first switch 420, and the second switch 440 may be canceled out by the decrease in the area of the phase shift circuit 470 due to the reduction in the number of processing bits. For example, when antenna elements are placed in 1×4 array and an antenna interval is λ/2 (e.g., λ is the length of the wavelength of the signal transmitted and received through an antenna), referring to Table 2, the third antenna module 246 may determine the direction (e.g., Beam Angle) of TX beam and/or RX beam through the combination of the phase shift interface 430 and the phase shift circuit 470.

TABLE 2

| Phase shift interface (430) | | Phase shift circuit (470) | | | | |
|---|---|---|---|---|---|---|
| Third distribution line (451) | Fourth distribution line (452) | First phase shifter (471) | Second phase shifter (472) | Third phase shifter (473) | Fourth phase shifter (474) | Beam Angle |
| d+λ/8 | d+λ | 157.5° (112.5°) | 0° (−45°) | 157.5° (−202.5°) | 0° (−360°) | −61° |
| d+λ/4 | d+λ | 135° (45°) | 0° (−90°) | 135° (−225°) | 0° (−360°) | −48.59° |
| d+λ/2 | d+λ | 157.5° (−22.5°) | 45° (−135°) | 112.5° (247.5°) | 0° (−360°) | −38.7° |
| d+λ/2 | d+λ | 90° (−90°) | 0° (−180°) | 90° (−270°) | 0° (−360°) | −30.00° |
| d+λ/2 | d+λ | 67.5° (−112.5°) | 0° (−180°) | 112.5° (−247.5°) | 45° (−315°) | −22° |
| d+λ/2 | d+λ | 45° (−135°) | 0° (−180°) | 135° (−225°) | 135° (−202.5°) | −14.48° |
| d+λ/2 | d+λ | 22.5° (−157.5°) | 0° (−180°) | 157.5° (−202.5°) | 45° (−135°) | −7.2° |
| d+λ/4 | d+λ/2 | 0° (−90°) | 0° ) (−90° | 90° (−90°) | 90° (−90°) | 0.00° |
| d+λ | d+λ/2 | 135° (−225°) | 157.5° (−202.5°) | 0° (−180°) | 22.5° (−157.5°) | 7.2° |
| d+λ | d+λ/2 | 90° (−270°) | 135° (−225°) | 0° (−180°) | 45° (−135°) | 14.48° |
| d+λ | d+λ/2 | 45° (−315°) | 112.5° (−247.5°) | 0° (−180°) | 67.5° (−112.5°) | 22° |
| d+λ | d+λ/2 | 0° (−360°) | 90° (−270°) | 0° (−180°) | 90° (−90°) | 30.00° |
| d+λ | d+λ/2 | 0° (−360°) | 112.5° (−247.5°) | 45° (−135°) | 157.5° (−22.5°) | 38.7° |
| d+λ | d+λ/4 | 0° (−360°) | 135° (−225°) | 0° (−90°) | 135° (45°) | 48.59° |
| d+λ | d+λ/8 | 0° (−360°) | 157.5° (−202.5°) | 0° (−45°) | 157.5° (112.5°) | 61° |

According to an embodiment, in Table 2, the phase shift interface 430 (e.g., one of the first to fourth phase shift lines 431 to 434) connected to the third distribution line 451 or the fourth distribution line 452 may be determined by the selection of the first switch 420 and the second switch 440. Each of the first to fourth phase shifters 471 to 474 may be set to one of phase values between 0 and 180 degrees. For example, the first to fourth phase shifters 471 to 474 may represent a phase value, using 3 bits. When only the phase shifters are used without a phase shift interface, the angles indicated in parentheses in Table 2 are the phase values that need to be implemented in each phase shifter to generate TX beam and/or RX beam in the same direction (e.g., Beam Angle). When there is no phase shift interface, phase shifters need to be implemented to have phase values between 0 and 360 degrees; on the other hand, because the phase shift circuit 470 of FIG. 4 only needs to be implemented to have phase values between 0 and 180 degrees, the phase shift circuit 470 using 3 bits may be implemented with a smaller area than the phase shifter using 4 bits.

According to an embodiment, the processor (e.g., the second communication processor 214) may select the phase shift interface 430 depending on TX beam and/or RX beam to be generated and may control the phase shift circuit 470. For example, the processor may control the first switch 420, the second switch 440, and the phase shift circuit 470 depending on the beam direction determined based on Table 2. For example, when the determined beam direction is 7.2 degrees, the first switch 420 may be configured to connect the first distribution line 411 to the first RFIC node 421 and to connect the second distribution line 412 to the second RFIC node 422. The second switch 440 may be configured to connect the third distribution line 451 to the first RFFE node 441 and to connect the fourth distribution line 452 to the second RFFE node 442. Furthermore, the first phase shifter 471 may be set to 135 degrees; the second phase shifter 472 may be set to 157.5 degrees; the third phase shifter 473 may be set to 0 degrees; and the fourth phase shifter 474 may be set to 22.5 degrees. According to various embodiments, Table 2 may be stored in a memory (e.g., the memory 130) in the form of a lookup table; the processor may control the first switch 420, the second switch 440, and the phase shift circuit 470 with reference to the lookup table stored in the memory.

Figure 5:
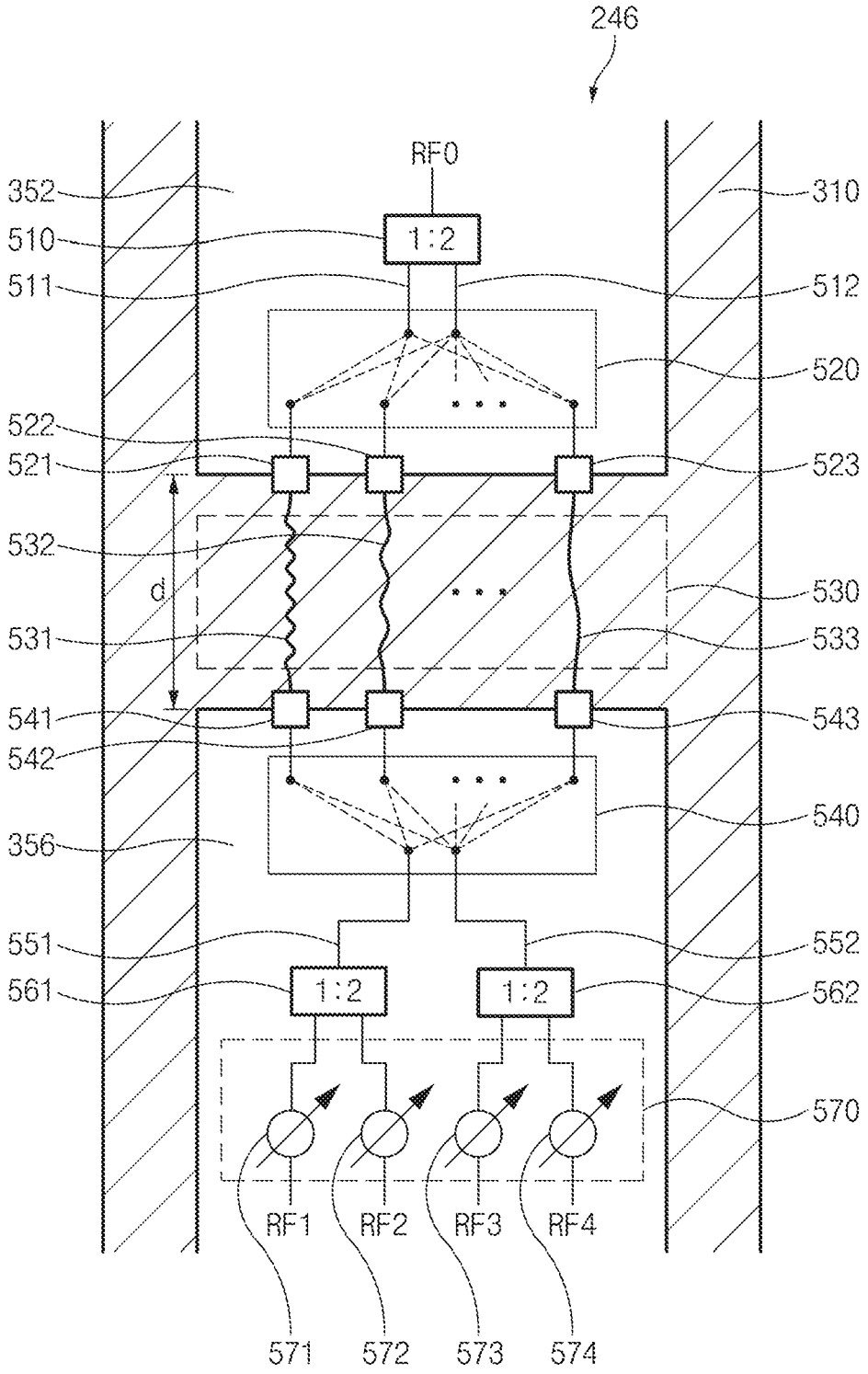
FIG. 5 is a diagram illustrating a connection structure of an RFFE chip including an RFIC chip and phase shifters according to an embodiment of the disclosure.

FIG. 5 is a diagram illustrating a connection structure of an RFFE chip including an RFIC chip and phase shifters according to an embodiment of the disclosure.

Referring to FIG. 5, according to an embodiment, the third antenna module 246 may include the printed circuit board 310, the RFIC 352, a phase shift interface 530, and/or the RFFE 356. Each of the RFIC 352 and the RFFE 356 may be formed of a single chip. In an embodiment, the RFIC 352 and the RFFE 356 may be mounted on the printed circuit board 310. The printed circuit board 310 may include antenna elements (e.g., the antenna element 332, 334, 336, or 338 of FIG. 3). Some of the configurations of the RFIC 352 or RFFE 356 of FIG. 5 may be the same as or similar to some of the configurations of the RFIC 352 or RFFE 356 of FIG. 4. The descriptions of the same or similar configurations to those of the RFIC 352 or the RFFE 356 of FIG. 4 among the configurations of the RFIC 352 or RFFE 356 of FIG. 5 will be omitted.

According to an embodiment, the RFIC 352 may include 'm' (e.g., 'm' is a natural number) RFIC nodes (e.g., first to m-th RFIC nodes 521 to 523). For example, a first switch 520 may connect one of first and second distribution lines 511 and 512 to one of the first to m-th RFIC nodes 521 to 523. For example, the first switch 520 may include a double-pole m-throw (DPmT) switch. The first and second distribution lines 511 and 512 further connect to a first divider 510.

According to an embodiment, the RFFE 356 may include 'm' RFFE nodes (e.g., first to m-th RFFE nodes 541 to 543). For example, a second switch 540 may connect one of the third and fourth distribution lines 551 and 552 to one of the first to m-th RFFE nodes 541 to 543. For example, the second switch 540 may include a double-pole m-throw (DPmT) switch. The RFFE 356 may include a second divider 561 and a third divider 562.

According to an embodiment, the phase shift interface 530 may connect the first to m-th RFIC nodes 521 to 523 to the first to m-th RFFE nodes 541 to 543. For example, a phase shift interface 530 may include 'm' phase shift lines (e.g., first to m-th phase shift lines 531 to 533). The first phase shift line 531 may connect the first RFIC node 521 to the first RFFE node 541. The second phase shift line 532 may connect the second RFIC node 522 to the second RFFE node 542. The m-th phase shift line 533 may connect the m-th RFIC node 523 to the m-th RFFE node 543.

According to an embodiment, the first to m-th phase shift lines 531 to 533 may have different lengths from one another. For example, the second to m-th phase shift lines 532 to 533 may be formed to have a specified phase difference from that of the first phase shift line 531. For example, when the length of the wavelength of the RF signal RF0 is λ and the distance between the RFIC nodes 521 to 523 and the RFFE nodes 541 to 543 is 'd', the first phase shift line 531 may have a length of 'd+λ'. The second phase shift line 532 may have a length of 'd+λ/2'. The m-th phase shift line 533 may have a length of $$'d + \frac{\lambda}{2^{(m-1)}}'.$$

In an embodiment, the phase shift interface 530 may be formed on one of the conductive layers of the printed circuit board 310.

According to an embodiment, the phase shift interface 530 and the phase shift circuit 570 may share a phase shift operation to perform the phase shift operation. For example, the phase shift interface 530 may perform phase shift of at least 1 bit. In various embodiments, the phase shift interface 530 may perform phase shift of 'k' bits (e.g., 'k' is a natural number). The phase shift circuit 570 may perform phase shift of 'n' bits (e.g., n is a natural number). For example, when the phase shift interface 530 performs phase shift of 'k' bits and the phase shift circuit 570 performs phase shift of 'n' bits, the third antenna module 246 may perform phase shift of total (k+n) bits. Accordingly, the phase shift circuit 570 only needs to perform phase shift of 'n' bits when the phase shift of total (k+n) bits is performed by the third antenna module 246, and thus the phase shift circuit 570 may be implemented with a smaller area than the phase shifter that needs to process the phase shift of (k+n) bits without a phase shift interface.

Figure 6:
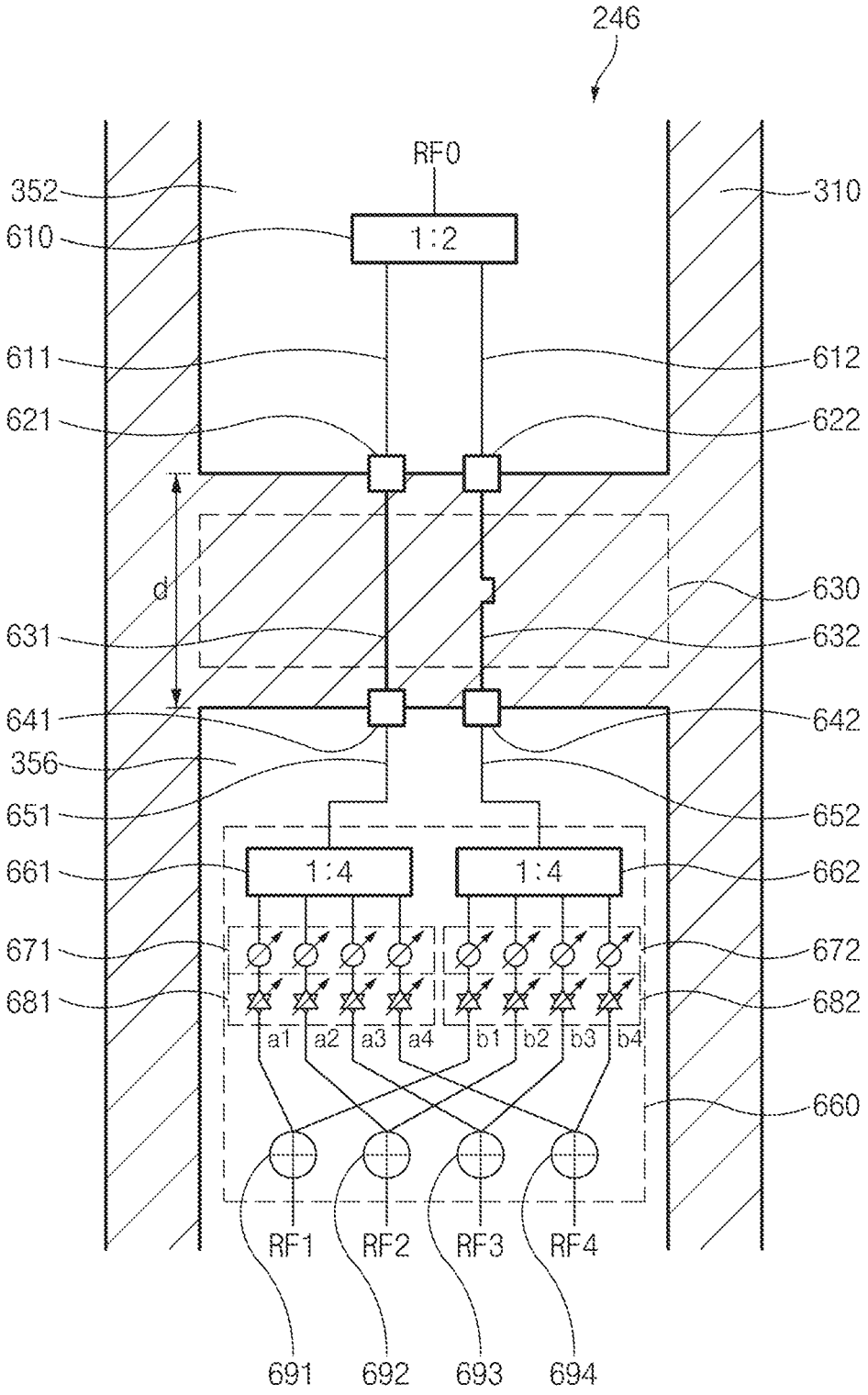
FIG. 6 is a diagram illustrating a connection structure of an RFFE chip including an RFIC chip and phase shifters according to an embodiment of the disclosure.

FIG. 6 is a diagram illustrating a connection structure of an RFFE chip including an RFIC chip and phase shifters according to an embodiment of the disclosure.

Referring to FIG. 6, the third antenna module 246 may include the printed circuit board 310, the RFIC 352, a phase shift interface 630, and/or the RFFE 356. Each of the RFIC 352 and the RFFE 356 may be formed of a single chip. The RFIC 352 and the RFFE 356 may be mounted on the printed circuit board 310. The printed circuit board 310 may include antenna elements (e.g., the antenna element 332, 334, 336, or 338 of FIG. 3).

According to an embodiment, the RFIC 352 may include a band conversion circuit (not illustrated) that converts a baseband signal (or IF signal) into an RF signal RF0 in a specified band or converts the RF signal RF0 into the baseband signal (or IF signal), a first divider 610, a first RFIC node 621, and a second RFIC node 622. For example, the first divider 610 may be connected to the first RFIC node 621 through a first distribution line 611. Furthermore, the first divider 610 may be connected to the second RFIC node 622 through a second distribution line 612.

According to an embodiment, the RFFE 356 may include a first RFFE node 641, a second RFFE node 642, and/or a vector modulator 660. For example, the vector modulator 660 may include a second divider 661, a third divider 662, first phase shifters 671, second phase shifters 672, first bidirectional variable gain amplifiers (VGAs) 681, second bidirectional VGAs 682, and/or first to fourth vector adders 691 to 694.

According to an embodiment, the first RFFE node 641 may be connected to the second divider 661 through a third distribution line 651. The second divider 661 may be connected to the first phase shifters 671. The first phase shifters 671 may be connected to the first bidirectional VGAs 681. The first bidirectional VGAs 681 may be connected to the first to fourth vector adders 691 to 694. The first to fourth vector adders 691 to 694 may be connected to the antenna elements.

According to an embodiment, the second RFFE node 642 may be connected to the third divider 662 through a fourth distribution line 652. The third divider 662 may be connected to the second phase shifters 672. The second phase shifters 672 may be connected to the second bidirectional VGAs 682. The second bidirectional VGAs 682 may be connected to the first to fourth vector adders 691 to 694.

According to an embodiment, an amplifier (not illustrated) may be interposed between the first to fourth vector adders (691 to 694) and the antenna elements. For example, at the time of transmission, the amplifier may include a PA that amplifies first to fourth RF signals RF1 to RF4 output by the first to fourth vector adders 691 to 694 and then supplies the amplified signals to the antenna elements. For another example, at the time of reception, the amplifier may include an LNA that amplifies signals received from the antenna elements and then delivers the first to fourth RF signals RF1 to RF4 to the first to fourth vector adders 691 to 694.

According to an embodiment, the phase shift interface 630 may connect the RFIC nodes 621 and 622 to the RFFE nodes 641 and 642, respectively. For example, the phase shift interface 630 may include a first phase shift line 631 and a second phase shift line 632. The first phase shift line 631 may connect the first RFIC node 621 to the first RFFE node 641. The second phase shift line 632 may connect the second RFIC node 622 to the second RFFE node 642.

According to an embodiment, the first phase shift line 631 and the second phase shift line 632 may have different lengths from each other. For example, the first phase shift line 631 and the second phase shift line 632 may be formed to have a specified phase difference (e.g., 90 degrees). The effect of generating a differential I-Q signal may be obtained by the phase difference between the first phase shift line 631 and the second phase shift line 632. For example, when the length of the wavelength of the RF signal RF0 is $\lambda$ and the distance between the RFIC nodes 621 and 622 and the RFFE nodes 641 and 642 is 'd', the first phase shift line 631 may have a length of 'd'. The second phase shift line 632 may have a length of '$d+\lambda/4$'. In an embodiment, the phase shift interface 630 may be formed on one of the conductive layers of the printed circuit board 310.

According to an embodiment, the phase shift interface 630 and the vector modulator 660 may perform a phase shift operation, using the differential I-Q signal. For example, the phase shift interface 630 may separate the RF signal RF0 into differential I-Q signals having the phase difference of 90 degrees.

According to an embodiment, the second divider 661, the first phase shifters 671, and the first bidirectional VGAs 681 may process I signal among the differential I-Q signals. For example, the first phase shifters 671 may perform phase shift of 1 bit on I signal. The first bidirectional VGAs 681 may adjust the gain of I signals, which are phase-shifted by the first phase shifters 671, to a specified magnitude.

According to an embodiment, the third divider 662, the second phase shifters 672, and the second bidirectional VGAs 682 may process Q signal among the differential I-Q signals. For example, the second phase shifters 672 may perform phase shift of 1 bit on the Q signal. The second bidirectional VGAs 682 may adjust the gain of the Q signals, which are phase-shifted by the second phase shifters 672, to a specified magnitude.

According to an embodiment, the first to fourth vector adders 691 to 694 may perform a vector sum operation of I signals corresponding to the first bidirectional VGAs 681 and the Q signals corresponding to the second bidirectional VGAs 682. For example, the first vector adder 691 may sum a first I signal a1 and a first Q signal b1. The second vector adder 692 may sum a second I signal a2 and a second Q signal b2. The third vector adder 693 may sum a third I signal a3 and a third Q signal b3. The fourth vector adder 694 may sum a fourth I signal a4 and a fourth Q signal b4.

According to an embodiment, the processor (e.g., the second communication processor 214) may control the vector modulator 430 depending on TX beam and/or RX beam to be generated.

According to an embodiment, each of the first phase shifters 671 and the second phase shifters 672 may perform phase shift of 1 bit; Accordingly, when the third antenna module 246 performs the phase shift of a total of 2 bits or more (e.g., 4 bits), the vector modulator 660 may be implemented with a smaller area than a phase shifter that needs to perform the phase shift of 2 bits or more (e.g., 4 bits). The increase in the area by the phase shift interface 630, the first bidirectional VGAs 681, the second bidirectional VGAs 682, and the first to fourth vector adders 691 to 694 may be canceled out by the decrease in the area of the vector modulator 660 (or the first phase shifters 671 and the second phase shifters 672).

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., an internal memory 136 or an external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to various embodiments disclosed in this specification, an antenna module included in an electronic device may separately use an RFIC chip implemented with CMOS and an RFFE chip implemented with a heterogeneous compound semiconductor, thereby improving the output power efficiency of an amplifier by placing the amplifier on the RFFE chip.

According to various embodiments disclosed in this specification, a phase shift interface is interposed between the RFIC chip and the RFFE chip, and phase shift is performed through the combination of the phase shift interface and the phase shifter included in the RFFE chip, thereby preventing the mounting area from increasing due to the use of two chips.

Besides, a variety of effects directly or indirectly understood through the disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

an antenna module comprising an antenna array comprising a plurality of antenna elements; and a processor operatively connected to the antenna module, wherein the antenna module comprises:

a printed circuit board;

conductive lines formed on the printed circuit board, each of the conductive lines having different lengths;

a communication circuit comprising a first switch connected to ends of the conductive lines; and a front-end comprising a second switch connected to opposite ends of the conductive lines and phase shifters connected to the second switch, wherein the phase shifters are connected to the plurality of antenna elements, and wherein the processor is configured to:

based on a direction of a beam to be formed by the antenna array, control the first switch and the second switch to select at least one of the conductive lines; and control a phase value of at least one of the phase shifters connected to the selected conductive line, based on a length of the selected conductive line.

2. The electronic device of claim 1, wherein the lengths of the conductive lines are determined based on a phase difference necessary to determine the direction of the beam.

3. The electronic device of claim 1, wherein the communication circuit further comprises:

a band conversion circuit configured to convert a baseband signal into a radio frequency (RF) signal in a specified band or to convert the RF signal into the baseband signal; and a first divider configured to divide or combine signal power of the RF signal, and wherein the first divider is interposed between the band conversion circuit and the first switch.

4. The electronic device of claim 3, wherein the front-end further comprises a second divider configured to divide or combine the signal power of the RF signal, and wherein the second divider connects at least one of the phase shifters to the second switch.

5. An electronic device comprising:

an antenna module comprising an antenna array comprising a plurality of antenna elements; and a processor operatively connected to the antenna module, wherein the antenna module comprises:

a printed circuit board;

a communication circuit mounted on the printed circuit board and comprising first access nodes;

a front-end mounted on the printed circuit board and comprising second access nodes and phase shifters connected to one selected among the second access nodes; and a phase shift interface interposed between the communication circuit and the front-end and comprising conductive lines configured to connect the first access nodes to the second access nodes, each of the conductive lines having different lengths, wherein the phase shifters are connected to the plurality of antenna elements, and wherein the processor is configured to:

based on a direction of a beam to be formed by the antenna array, select at least one of the conductive lines; and control a phase value of at least one of the phase shifters connected to the selected conductive line, based on a length of the selected conductive line.

6. The electronic device of claim 5, wherein the communication circuit further comprises:

a first switch connected to the first access nodes, the first switch configured to select at least one of the first access nodes under control of the processor; and a first divider connected to the first switch, the first divider configured to divide or combine signal power of a radio frequency (RF) signal.

7. The electronic device of claim 6, wherein the front-end comprises:

a second switch connected to the second access nodes, the second switch configured to select at least one of the second access nodes under the control of the processor; and a second divider connected to the second switch, the second divider configured to divide or combine the signal power of the RF signal.

8. The electronic device of claim 7, wherein the second divider is connected to at least part of the phase shifters.

9. The electronic device of claim 7, wherein ends of the conductive lines are connected to the first access nodes respectively to form one-to-one connections, wherein opposite ends of the conductive lines are connected to the second access nodes respectively to form one-to-one connections, and wherein the processor is further configured to:

control the first switch and the second switch to determine the selected conductive line.

10. The electronic device of claim 9, wherein the lengths of the conductive lines are determined based on a specified phase difference, which is implemented through a combination of at least one of the conductive lines and the phase shifters, for determining the direction of the beam which is formed by the antenna array.

11. The electronic device of claim 10, wherein the specified phase difference has a value between 0 and 180 degrees, and wherein each of the phase shifters is set to a phase value between 0 and 180 degrees.

12. The electronic device of claim 9, wherein the lengths of the conductive lines are determined in proportion to a length of a wavelength of an RF signal processed by the phase shifters.

13. The electronic device of claim 9, wherein the conductive lines are formed on at least one conductive layer of the printed circuit board.

14. An electronic device comprising:

an antenna module comprising an antenna array comprising a plurality of antenna elements; and a processor operatively connected to the antenna module, wherein the antenna module comprises:

a printed circuit board;

a communication circuit mounted on the printed circuit board and comprising first access nodes;

a front-end mounted on the printed circuit board and comprising second access nodes and a vector modulator connected to the second access nodes; and a phase shift interface interposed between the communication circuit and the front-end and comprising conductive lines for implementing at least one phase difference by connecting the first access nodes to the second access nodes, wherein the vector modulator provides the plurality of antenna elements with radio frequency (RF) signals, on which a phase shift is performed based on differential in-phase and quadrature (I-Q) signals generated depending on the at least one phase difference, and wherein the processor is configured to control the vector modulator based on a direction of a beam formed by the antenna array.

15. The electronic device of claim 14, wherein the communication circuit comprises:

a first divider configured to divide or combine signal power;

a first node connected to a first terminal of the first divider; and a second node connected to a second terminal of the first divider, wherein the phase shift interface comprises:

a first conductive line connected to the first node; and a second conductive line connected to the second node, and wherein the first conductive line and the second conductive line have a phase difference of 90 degrees from each other.

16. The electronic device of claim 15, wherein the front-end comprises:

a third node connected to the first conductive line;

a fourth node connected to the second conductive line;

a second divider connected to the third node; and a third divider connected to the fourth node.

17. The electronic device of claim 16, wherein the front-end further comprises:

first phase shifters connected to the second divider;

first bidirectional variable gain amplifiers connected to the first phase shifters respectively to form one-to-one connections; and vector adders connected to the first bidirectional variable gain amplifiers respectively to form one-to-one connections.

18. The electronic device of claim 17, wherein the front-end further comprises:

second phase shifters connected to the third divider; and second bidirectional variable gain amplifiers connected to the second phase shifters respectively to form one-to-one connections, and wherein the second bidirectional variable gain amplifiers are connected to the vector adders.

19. The electronic device of claim 18, wherein the vector adders perform a vector operation on one of outputs of the first bidirectional variable gain amplifiers and one of outputs of the second bidirectional variable gain amplifiers to provide the performed result of the vector operation to one of the plurality of antenna elements.

20. The electronic device of claim 18, wherein each of the first phase shifters and each of the second phase shifters perform a phase shift of 1 bit.

21. The electronic device of claim 14, further comprising:

a first communication processor; and a second communication processor.

22. The electronic device of claim 21, wherein the second communications processor is configured to control the vector modulator based on at least one of a transmission beam or a reception beam being generated.

23. The electronic device of claim 14, wherein the phase shift interface is configured to separate a radio frequency (RF) signal RF0 into differential I-Q signals having a phase difference of 90 degrees.

* * * * *